United States Patent [19]

Klomp et al.

[11] 4,194,623

[45] Mar. 25, 1980

[54] PACKAGED ELECTRIC LAMP

[75] Inventors: Franciscus M. Klomp; Marinus Overmars, both of Eindhoven, Netherlands

[73] Assignee: U.S. Philips Corporation, New York, N.Y.

[21] Appl. No.: 934,989

[22] Filed: Aug. 18, 1978

[30] Foreign Application Priority Data

Sep. 7, 1977 [NL] Netherlands ..... 7709817

[51] Int. Cl.[2] ..... B65D 85/42

[52] U.S. Cl. ..... 206/418; 229/39 B

[58] Field of Search ..... 206/418, 422; 229/39 B, 229/52 BC

[56] References Cited

U.S. PATENT DOCUMENTS

| | | | |
|---|---|---|---|
| 2,619,227 | 11/1952 | Arthur | 206/419 |
| 3,570,706 | 3/1971 | Harrelson | 229/52 BC |

FOREIGN PATENT DOCUMENTS

| | | | |
|---|---|---|---|
| 702024 | 1/1954 | United Kingdom | 206/418 |

*Primary Examiner*—William T. Dixson, Jr.

*Attorney, Agent, or Firm*—Thomas A. Briody; William J. Streeter; Rolf E. Schneider

[57] ABSTRACT

An electric lamp package comprising a lamp envelope formed with a convex portion and having a packaging strip extending therearound with its ends engaging each other substantially flat beyond the lamp cap. Each long side of the packaging strip is formed with a pair of lengthwise incisions to form a central portion in contact with the convex portion of the lamp envelope and a pair of edge portions extending along the central portion and being in opposite lateral contact with the lamp envelope. The corresponding edge portions of the two oppositely disposed long sides are secured together.

2 Claims, 10 Drawing Figures

PACKAGED ELECTRIC LAMP

Figure 1:
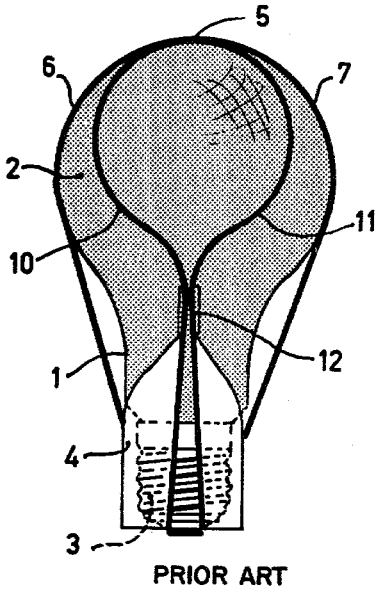

This invention relates to a packaged electric lamp whose lamp envelope has a neck which adjoins at one end a convex portion with a lamp base or cap connected at the other end, the package consisting of an elongate strip extending from the lamp cap, the strip being bent in a curve around the lamp envelope, back to the lamp cap and having an incision along each of its long sides in each of the two parts formed by bending, each incision at the area forming an edge strip with the respective long side, opposite edge strips being locally connected together.

Such a packaged electric lamp is disclosed in British Pat. No. 702,024. An attractive aspect of the known product is that little constructional material is required for the package as compared with boxes and sheets. Furthermore, the strip of packaging material with incisions can be used directly to package a lamp. In contrast with boxes, the blank does not need to be initially prepared by a folding and securing operation before the lamp can be packaged in it. In fact, the package is obtained from the blank by bending it in the form of a U-shape around the lamp envelope and connecting together the limbs of the U-shape on either side of the lamp. It is sufficient when this is done in a total of only two places.

In the known product, the incisions in the packaging strip extend from a place situated opposite the upper edge of the lamp cap, that is the edge where the lamp envelope joins the lamp cap, along the lamp envelope, beyond the widest part of the lamp envelope to near its top. The incisions are made along curved lines so that two incisions extending beside each other have their smallest mutual distance near their ends. Consequently, in the known product the edge strips resulting from making the incisions lie laterally against the convex portion of the lamp envelope. As a result of this the lamp is mainly fixed in the package with the convex lamp envelope portion enclosed.

The package has no incisions alongside the lamp cap. Since oppositely located edge strips are locally connected together at the neck, the packaging strip is curved over the lamp cap in a direction transverse to the lamp axis. In spite of the fact that the package extends only up to the bottom of the lamp cap, most of the lamp cap is hidden from view. This is undesirable since when purchasing a lamp it is necessary to know which one of the several possible alternative types of lamp cap has been fitted.

It has furthermore been found that tears can easily occur in the material of the known package because said package comprises places having sharply curved portions and hence large stresses can occur. Such places are, for example, at the ends of the incisions situated near the lamp cap. Another disadvantage is that the packaging strip near said places substantially engages the lamp just at the area where the lamp cap adjoins the lamp envelope. In lamps this is a vulnerable place where the package should on the contrary have a buffering effect.

It is the object of the present invention to provide a packaged lamp in which the visibility of the lamp in the package is increased, in which the resistance of the package against tears is improved and in which the lamp in the place where the base or cap joins the envelope is better protected, while nevertheless the advantages of the known package, namely the small number of places in which interconnections of the parts of the packaging strip have to be effected, are maintained.

According to the invention, there is provided a packaged electric lamp whose lamp envelope has a neck which adjoins at one end a convex portion with a lamp cap connected at the other end, the package consisting of an elongate strip extending from the lamp cap, the strip being bent in a curve around the lamp envelope, back to the lamp cap and having an incision along each of its long sides in each of the two parts formed by bending, each incision at the area forming an edge strip with the respective long side, opposite edge strips being locally secured together, the two parts of the strip formed by bending extending to beyond the lamp cap. The incisions in the strip begin at the level of a place situated on the convex portion between the neck and the largest cross-section of the convex portion and continue to beyond the lamp cap but at a distance from the end of the strip, the edge strips enclosing the lamp cap laterally.

In lamps packaged according to the invention both the shape and the nature of the lamp cap and the lamp envelope are entirely visible from the side.

Since the incisions begin at the level of a wider portion of the lamp envelope and continue to beyond the lamp cap, the packaging material which is situated between the incisions is present at some distance from the lamp cap and the lamp envelope at the area where these join each other, thus forming a buffer. The edge strips absorb impacts which come from the sides.

When packaged lamps are stacked alternately, a resilient pack is obtained as a result of the presence of the said buffers, which is of importance for packaging the products in shipping containers. The packaging of the lamps proves to have a good resistance to tearing. Drop tests with the products in shipping containers have demonstrated that the products are at least equal to lamps packaged in boxes and packed in the same shipping containers.

An additional advantage of the products according to the invention is that they are slimmer. Since the edge strips are not situated beside the largest cross-section of the lamp envelope, it will suffice to use strips of packaging material the width of which is substantially equal to the largest diameter of the lamp. In general, however, the width will be chosen to be slightly larger, for example, one to a few millimeters larger. This not only provides savings of material but also savings in shipping costs.

In contrast with the known product, the lamp packaged according to the invention is mainly fixed in the package in that the lamp cap is enclosed. Dependent on the mutual distance between the incisions, the lamp cap is situated between the edge strips with a small amount of play, in a close-fitting or clamped manner. Where the edge strips extend on the side of the lamp envelope, the mutual distance between the incisions is in general greater than at the level of the lamp cap due to the larger dimension of the lamp at that area. Preferably, however, the edge strips at least partly engage the lamp.

The two parts of the strip of packaging material, for example, duplex paper board, triplex paper board and so on, are usually connected together at the side of the lamp cap, for example by riveting or gluing. The connection places may be situated alongside the edge of the lamp cap where it engages the lamp envelope, or in the immediate proximity thereof, although the connection can also be realised more in the direction of the convex lamp envelope portion. Although connections can be provided in several places, a total of two connections situated on either side of the lamp is usually adequate.

An attractive aspect of the products according to the invention is that they are suitable for display in a suspended position. In fact, the two parts of the strip, in so far as they extend to beyond the lamp cap, engage each other substantially flatly. At that area an aperture, for example a slot-like aperture, can be punched in the strip so that it can be used as a pin pack enabling the packaged lamp to be suspended from a hook.

In a preferred embodiment of the products according to the invention, a lug is punched out of each of the two strip parts, which lugs extend in the longitudinal direction of the lamp to beyond the lamp envelope. The lugs enable the products to be presented also in a standing position with the lamp cap uppermost. A second function of the lugs, however, is that of a buffer, which makes the packaged lamps even more resistant to impact. For optimum stability of the standing product, the lugs are preferably cut out in such a manner as to have a large mutual distance. On the other hand it is not desirable to move the connection point of the lugs towards the lamp cap over such a distance that the lugs obtain a large length and hence become slacker. Usually, the connection point of the lugs will be situated on the side of the largest cross-section of the lamp envelope remote from the lamp cap, generally alongside the place where the lamp envelope has a transverse dimension of 0.8 to 0.9 times its maximum transverse dimension. The advantage thereof is that the lugs, when the strip is bent around the lamp envelope, automatically assume a correct position and produce a great stability.

The invention is particularly suitable for use with electric incandescent lamps, in particular incandescent lamps for general illumination purposes, silver-cupped lamps, reflector lamps and the like, but it is also suitable for gas discharge lamps. The convex lamps envelope portion may have a variety of shapes, from spherical to conical.

The strips of packaging material used according to the invention may also form one assembly with other packaging strips so that multipacks are obtained. These have preferably score lines so as to be easily split into separate packs.

Figure 2:
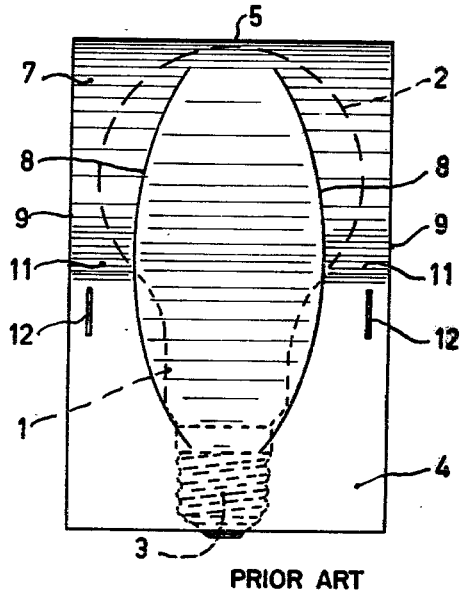

The invention also relates to a blank packaging strip suitable for use for the above-described purposes. dr The invention will now be explained with reference to the accompanying drawings, in which:

FIGS. 1 and 2 are side and front elevations of a packaged lamp according to the aforementioned British Pat. No. 702,024.

Figure 3:
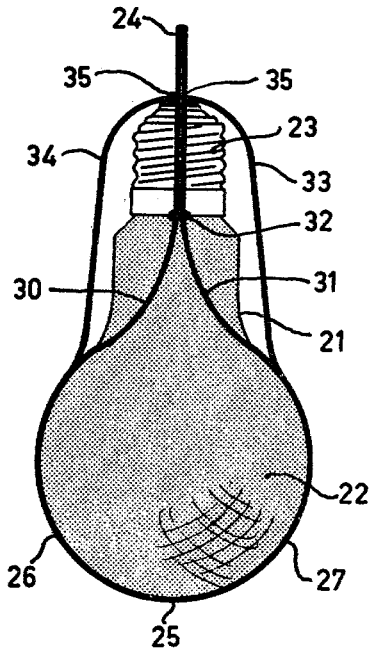
Figure 4:
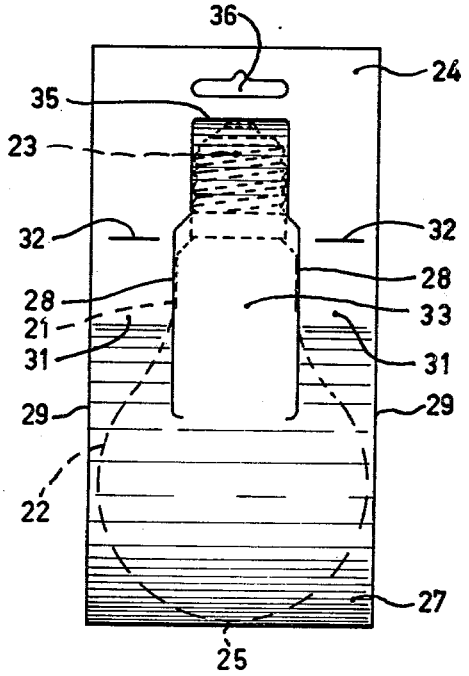
Figure 5:
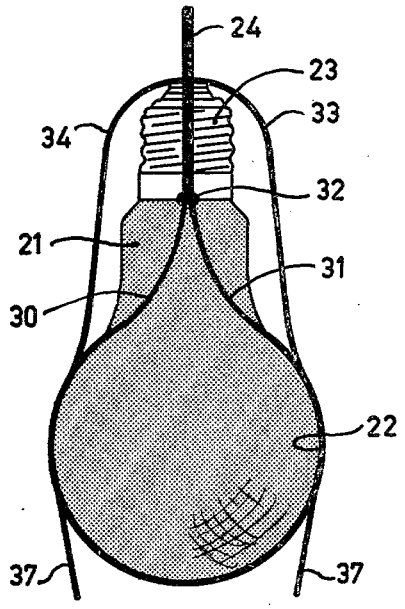
Figure 6:
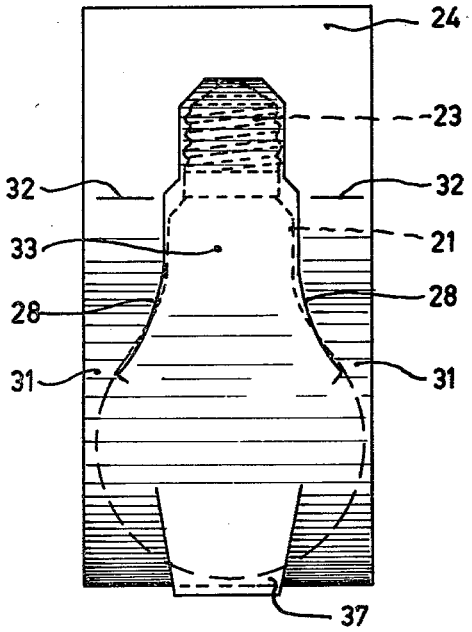
Figure 7:
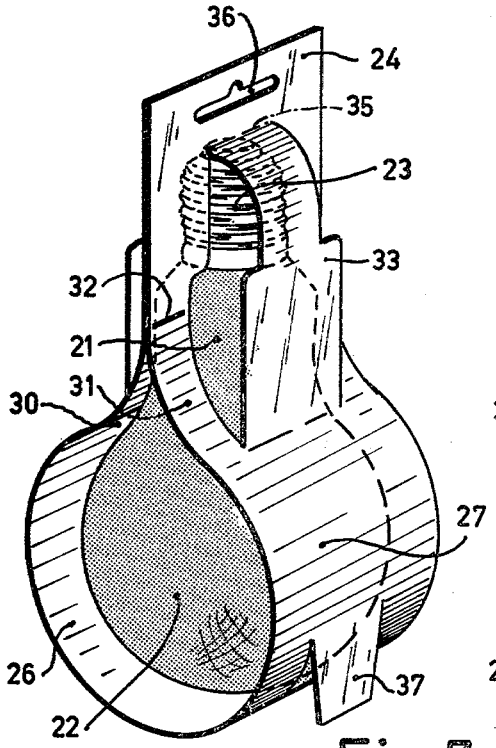
Figure 8:
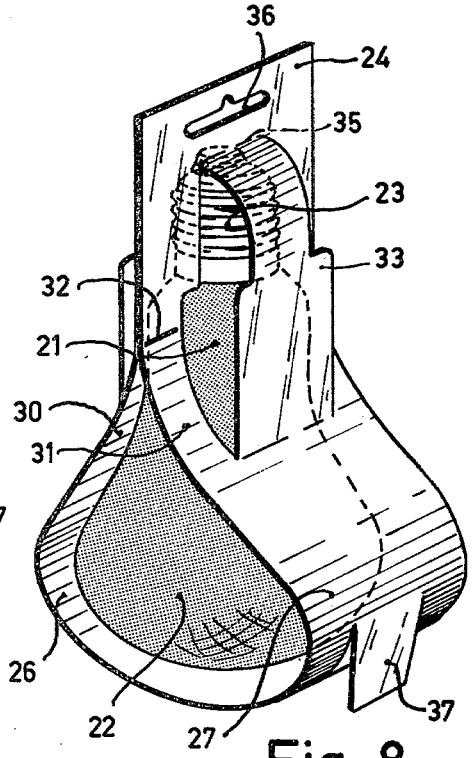
Figure 9:
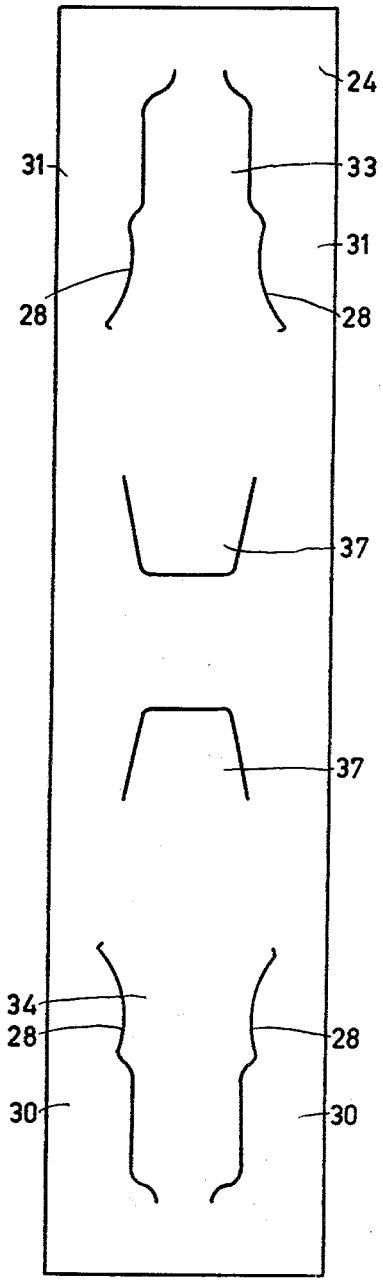
Figure 10:
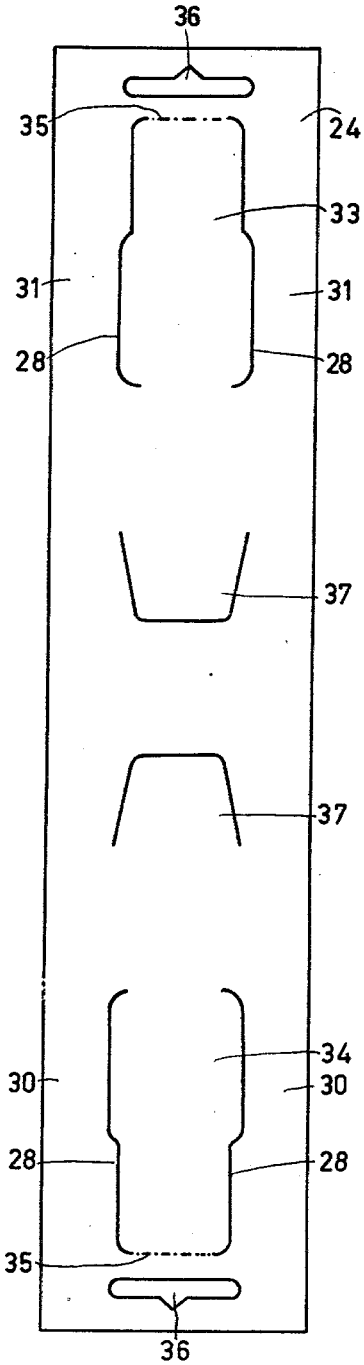

FIGS. 3 and 4 are side and front elevations of a packaged lamp according to the invention, FIGS. 5 and 6 are side and front views of a different embodiment, FIG. 7 is a perspective view of a packaged lamp of a further embodiment, FIG. 8 shows a packaged lamp having a different shape of convex lamp envelope, FIG. 9 shows a plano packaging strip as used in FIGS. 5 and 6, and FIG. 10 shows a plano packaging strip as used in FIG. 7.

The packaged lamp shown in FIGS. 1 and 2 has an envelope with a neck 1 which adjoins at one end a spherical portion 2 and to which is connected at the other end a lamp cap 3. An elongate strip 4 of board extends from the lamp cap 3, is shaped into a curve 5 around the spherical portion 2, and continues back to the lamp cap. In each of its two portions 6 and 7 formed by a bend at the curve 5, the strip 4 has incisions 8 extending along the long sides 9 of the strip 4 and constituting with said sides 9 edge strips 10 in strip portion 6 and edge strips 11 in strip portion 7. Oppositely located edge strips 10 and 11 are locally connected together at 12.

The edge strips 10 and 11 lie laterally against the lamp and fix same mainly on the spherical lamp envelope portion 2 in that they begin already near the curve 5 and extend only to the lamp cap 3. The lamp cap 3 is partially visible only in the side elevation.

In FIGS. 3 and 4 the lamp envelope has a neck 21 which adjoins at one end a spherical portion 22 and to which is connected at the other end a lamp cap 23. An elongate strip 24 of duplex paper board (weight between 230 and 400 g/m$^2$) is shaped in a curve 25 around the spherical portion 22. The formed parts 26 and 27 of the strip 24 extend along the lamp envelope to beyond the lamp cap 23.

In each of the two parts 26 and 27 of the strip 24, incisions 28 are made along the long sides 29 of said strip and form with said long sides 29 edge strips 30 and 31. Oppositely located edge strips 30 and 31 are connected together locally at 32. As a result of this the lamp cap 23 is enclosed in the package. The incisions do not extend along the widest part of the lamp envelope.

In FIG. 3 the shape of both the lamp envelope and the lamp cap are fully visible. In spite of the presence of the packaging, the size of the lamp cap and the colour and the degree of transparency of the lamp envelope can be observed.

The parts 33 and 34 of the strip 24 situated between edge strips 30 and 31 constitute a resilient buffer for the neck 21 and the lamp cap 23.

In this embodiment, a score line 35 is provided at the end of each part 33 and 34 near the lamp cap. In addition, an aperture 36 is punched in the packaging strip so as to be able to suspend the packaged lamp.

In FIGS. 5 and 6 the reference numerals respectively to those of FIGS. 3 and 4.

In the embodiment shown the incisions 28 are shaped so as to correspond with the contours of the packaged lamp. A lug 37 enabling a standing presentation of the packaged lamp is punched in the strip 24 on either side of the lamp.

The reference numerals in FIGS. 7 to 10 correspond respectively to those of FIGS. 3 to 6.

What is claimed is:

1. An electric lamp package, which comprises a lamp envelope having a neck adjoining at one end a convex portion and connected at the other end to a lamp cap; an elongate packaging strip extending at one end from beyond the lamp cap and bent around the convex portion of the lamp envelope and extending at its other end back beyond the lamp cap to form two oppositely disposed long sides, said two extending ends engaging each other substantially flatly; a pair of lengthwise incisions in each long side to provide a packaging strip central portion in contact with the abutting convex portion of the lamp envelope and two packaging strip edge portions extending along said central portion and being in opposite lateral edge-wise contact with the lamp envelope, the central portion of each long side extending from the bottom of the lamp cap to an area on the lamp envelope convex portion between the lamp envelope neck and the greatest cross section of said convex portion; and means to secure together the corresponding edge portions of the two oppositely disposed long sides.

2. An electric lamp package according to claim 1, which includes a lug extending from each long side beyond the convex portion of the lamp envelope on the other side of the greatest cross section of said convex portion in an area where the convex portion has a transverse dimension 0.8–0.9 times its maximum transverse dimension.

* * * * *